US008490688B2

(12) United States Patent
Gaudette

(10) Patent No.: US 8,490,688 B2
(45) Date of Patent: Jul. 23, 2013

(54) METHODOLOGY FOR SETTING OF AN INFLATABLE PACKER USING SOLID MEDIA

(75) Inventor: Sean L. Gaudette, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 118 days.

(21) Appl. No.: 11/970,923

(22) Filed: Jan. 8, 2008

(65) Prior Publication Data

US 2009/0173499 A1 Jul. 9, 2009

(51) Int. Cl.
*E21B 33/127* (2006.01)

(52) U.S. Cl.
USPC ..... 166/130; 166/51; 166/142; 166/187; 166/278; 166/387; 277/333

(58) Field of Classification Search
None
See application file for complete search history.

(56) References Cited

U.S. PATENT DOCUMENTS

| | | | | |
|---|---|---|---|---|
| 4,320,800 | A * | 3/1982 | Upchurch | 166/106 |
| 6,508,305 | B1 * | 1/2003 | Brannon et al. | 166/293 |
| 7,325,621 | B2 * | 2/2008 | Naquin et al. | 166/387 |
| 7,597,152 | B2 | 10/2009 | Wood et al. | |
| 2002/0092654 | A1 * | 7/2002 | Coronado et al. | 166/369 |
| 2004/0129431 | A1 * | 7/2004 | Jackson | 166/384 |
| 2004/0256114 | A1 * | 12/2004 | Coronado | 166/387 |
| 2005/0061520 | A1 * | 3/2005 | Surjaatmadja et al. | 166/387 |
| 2006/0090903 | A1 * | 5/2006 | Gano et al. | 166/384 |
| 2007/0277979 | A1 * | 12/2007 | Todd et al. | 166/287 |

OTHER PUBLICATIONS

Paul Wilson and Corey E. Hoffman, SPE, Weatherford, "Thermally Compensated Inflatable Packers and Plugs", Production Technology, Oct. 2000, p. 26.

Society of Petroleum Engineers "Technology Update, Inflatable-Packer Well-Intervention Techniques Cut Rig Time, Costs", The Journal of Petroleum Technology, vol. 56 No. 4; Apr. 2004, pp. 1-2.

* cited by examiner

*Primary Examiner* — Zakiya W. Bates

(74) *Attorney, Agent, or Firm* — Cantor Colburn LLP

(57) ABSTRACT

A seal includes a mandrel; an element disposed radially adjacent the mandrel; a chamber defined between the mandrel and the element; and a pressure regulator in fluid communication with the chamber, the regulator configured to resist fluid flow to a selected threshold pressure related to element expansion and method.

16 Claims, 2 Drawing Sheets

METHODOLOGY FOR SETTING OF AN INFLATABLE PACKER USING SOLID MEDIA

BACKGROUND

In the hydrocarbon recovery industry, sealing structures such as packers have long been used for various sealing duties. While the ultimate purpose of sealing is the same, there have been many different kinds of structures used. Indeed, entire development arms have built up over the years for different types of packers/seals. These structures may be mechanical, inflatable, etc. While all of the currently available packers/seals have an environment in which they function well, the industry as a whole continues to evolve and produce new environments in which such devices are meant to function. This often exposes a need for new technology to ensure reliable service for an acceptably long period of time.

SUMMARY

A seal includes a mandrel; an element disposed radially adjacent the mandrel; a chamber defined between the mandrel and the element; and a pressure regulator in fluid communication with the chamber, the regulator configured to resist fluid flow to a selected threshold pressure related to element expansion.

A method for setting a seal with particulate matter includes pressurizing the seal with a particulate laden fluid; expanding the seal to an intended final set of dimensions; flowing the fluid; and depositing the particulate in the seal.

BRIEF DESCRIPTION OF DRAWINGS

Referring now to the drawings wherein like elements are numbered alike in the several Figures.

DETAILED DESCRIPTION

Figure 1:
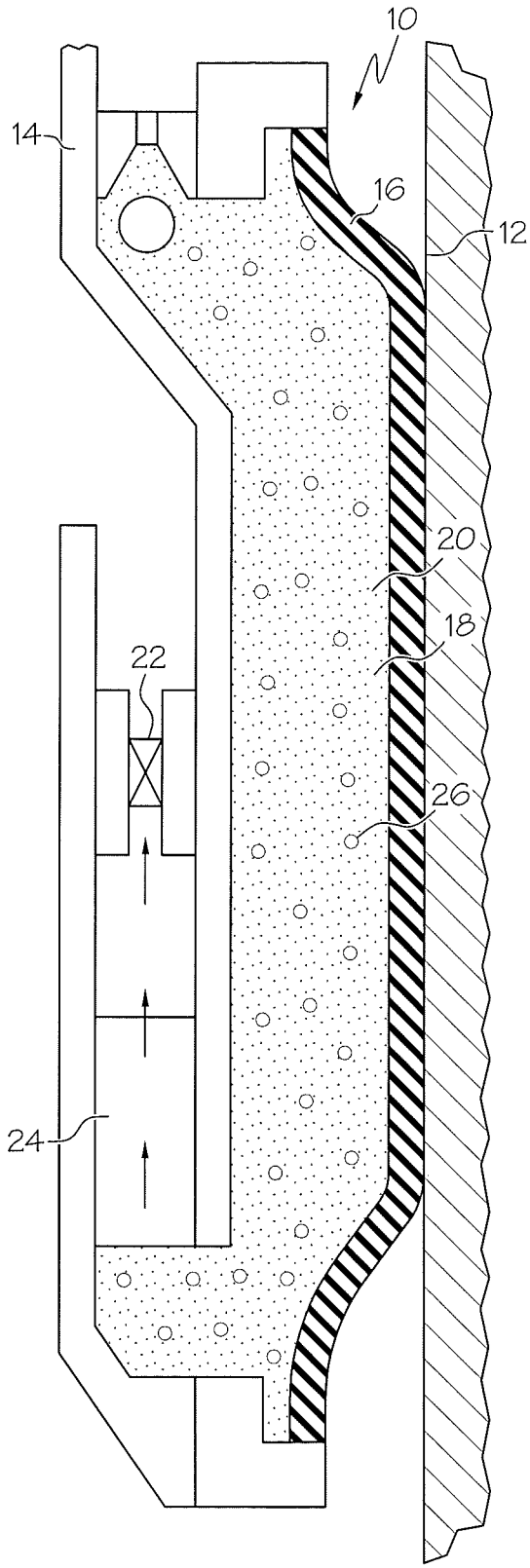
FIG. 1 is a schematic view of a packer as disclosed herein during an expansion phase of the filling process.
Figure 2:
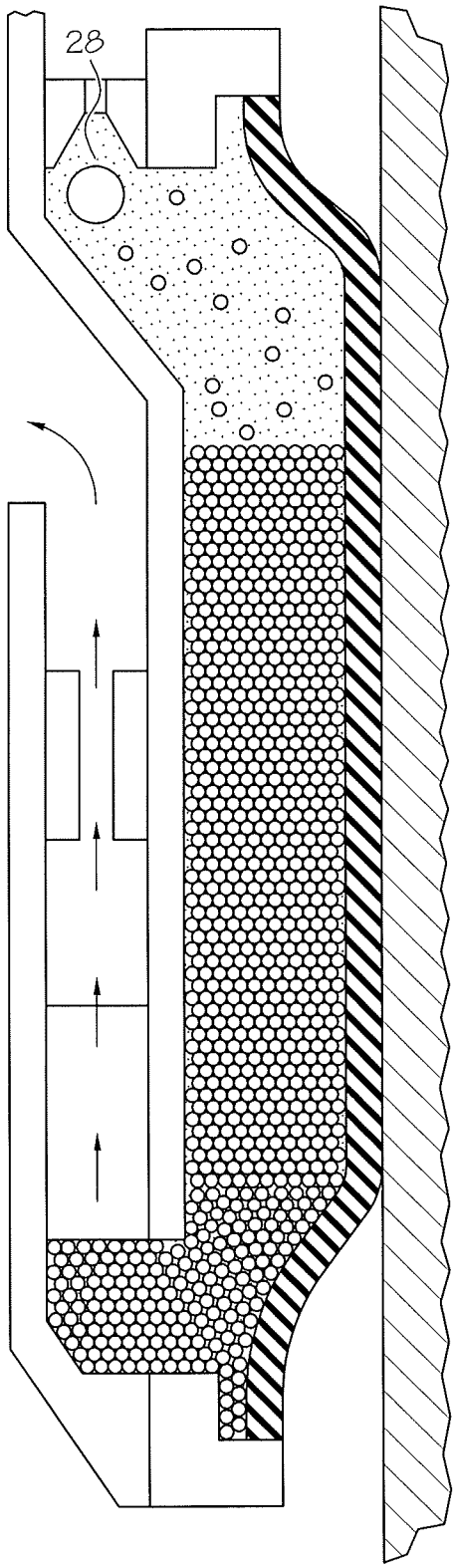
FIG. 2 is the device of FIG. 1 during a packing phase of the filling process.

Referring to FIG. 1, a particulate filled seal 10 is illustrated in an expansion phase a filling process. The seal 10 is illustrated in position within another structure 12 with which a seal is to be affected. One such structure 12 is a casing tubular in a hydrocarbon wellbore. The seal 10 comprises a mandrel 14 and a substantially fluid impermeable element 16 disposed radially spaced from the mandrel 14. A chamber 18 defined between the element 16 and the mandrel 14 is configured to accept a fluid 20 and to regulate the exit of that fluid. The regulated exit is a pressure regulator 22. The pressure regulator 22 may be configured in many different types of commercially available regulators. A biased flapper valve is one example while other examples include: a rupture disk, adjustable spring check valve, pilot operated relief valve, etc. Whatever regulator is selected its purpose is to hold pressure until a threshold pressure is reached by fluid 20 within the chamber 18. Holding pressure until the threshold pressure causes the element 16 to respond to the full applied pressure of the fluid in order to ensure that the element is expanded fully against the structure 12 (or simply expanded to an intended final set of dimensions) prior to the filling of the element 16 with particulate matter. While grain-to-grain contact of the particulate matter in the element 16 will make the element solidly inflated, the contact pressure against the structure 12 is in some cases less than adequate when simply relying on grain loaded particles to effect the expansion the element 16. As disclosed herein, then, the expansion is ensured using the fluid pressure rather than solely the grain contact.

Still referring to FIG. 1, it is desirable to provide a screen 24 sufficient to prevent any particulate 26 from escaping from the chamber 18. The screen is placed just upstream of the regulator 22 in one embodiment, as illustrated, though it is to be understood that the regulator need only be downstream of the element 16 to provide its specific purpose of expansion of the element 16. If the regulator 22 is placed upstream of the screen 24, consideration of the particulate matter 26 interaction with the regulator 22 must be given. If the regulator 22 is positioned downstream of the screen as illustrated, the regulator need be less robust as the particulate 26 is screened out of the fluid 20 before fluid 20 reaches the regulator 22. In one embodiment, the regulator 22 is also configured to close after the filling operation is complete but it is to be understood that such is not necessary since once the particulate 26 fills the chamber 18 a check valve 28 closes preventing the particulate matter 26 from migrating out of the element 16 in the direction from which it was introduced thereto and the screen 24 prevents that particulate from exiting the element at the downstream end. In the event that a fluid leak path through the seal 10 is a concern, then a closeable regulator 22 will be desirable to prevent fluid from migrating through the particulate matter in an upstream direction relative to the original direction of filling.

While any type of particulate material is possible for use with the seal and method of this invention, it is noted that in one particular embodiment, a resilient particulate material is selected. Such a resilient particulate material may comprise an elastomeric material, such as nitrile rubber, fluoroelastomer, etc. Resilient material utilized as the particulate 26 or at least as a component of the particulate 26 provides a rebound force to the seal 10 that is useful to allow the seal to remain sealed during pressure reversals. Resilience significantly enhances reliability of the seal 10.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A seal comprising:

a mandrel;

an inflatable element disposed radially adjacent the mandrel;

a chamber defined between the mandrel and the element, the chamber operatively arranged to receive a flow of particulate laden fluid; and a pressure regulator in fluid communication with the chamber and downstream of the element, the regulator configured to resist fluid flow to a selected threshold pressure related to element expansion, the seal operatively arranged to retain the particulate from the flow of particulate laden fluid in the chamber even after the threshold pressure has been achieved.

2. The seal as claimed in claim 1 wherein the element expansion is to an intended final set of dimensions of the element.

3. The seal as claimed in claim 1 wherein the pressure regulator closes when fluid pressure falls below the threshold pressure.

4. The seal as claimed in claim 1 wherein the seal further includes a check valve positioned at an inlet end of the element.

5. The seal as claimed in claim 1 wherein the chamber is filled with particulate matter, at least a portion of which is resilient material.

6. The seal as claimed in claim 5 wherein the particulate matter is in grain-to-grain contact.

7. The seal as claimed in claim 1 wherein the chamber is filled with resilient material.

8. A method for setting a seal with particulate matter comprising:

pressurizing a seal according to claim 1 with a particulate laden fluid;

expanding the inflatable element of the seal to an intended final set of dimensions;

flowing the fluid through the seal;

depositing the particulate in the seal as a result of the fluid flowing through the seal; and maintaining the final set of dimensions with the particulate.

9. The method as claimed in claim 8 wherein the flowing occurs only subsequent to a pressure in the fluid reaching a threshold pressure.

10. The method as claimed in claim 8 wherein the expanding is against another structure.

11. The method as claimed in claim 10 wherein the another structure is a tubular.

12. The method as claimed in claim 8 wherein the particulate comprises resilient material.

13. The method as claimed in claim 8 wherein the particulate is a resilient material.

14. The seal of claim 1, wherein the chamber includes an inlet that permits the fluid flow into the chamber for inflating the inflatable element due to a pressure of the fluid flow, the fluid flowing through the chamber out via the pressure regulator when the threshold pressure is reached or exceeded.

15. The seal of claim 1, further comprising a screen operatively arranged to cause the particulate to be retained in the chamber while permitting fluid to flow therethrough.

16. The seal of claim 15, wherein the screen is disposed between the pressure regulator and the chamber.

* * * * *